US010196581B2

(12) United States Patent
Walker et al.

(10) Patent No.: US 10,196,581 B2
(45) **Date of Patent: *Feb. 5, 2019**

(54) METHOD OF LUBRICATING A TRANSMISSION WHICH INCLUDES A SYNCHRONIZER WITH A NON-METALLIC SURFACE

(71) Applicant: The Lubrizol Corporation, Wickliffe, OH (US)

(72) Inventors: Gary M. Walker, Allestree (GB); Gareth Brown, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/908,580

(22) PCT Filed: Jul. 22, 2014

(86) PCT No.: PCT/US2014/047513

§ 371 (c)(1),
(2) Date: Jan. 29, 2016

(87) PCT Pub. No.: WO2015/017172

PCT Pub. Date: Feb. 5, 2015

(65) Prior Publication Data

US 2016/0208191 A1 Jul. 21, 2016

Related U.S. Application Data

(60) Provisional application No. 61/860,310, filed on Jul. 31, 2013.

(51) Int. Cl.

| | |
|---|---|
| ***C10M 105/04*** | (2006.01) |
| ***C10M 129/40*** | (2006.01) |
| ***C10M 135/10*** | (2006.01) |
| ***C10M 137/02*** | (2006.01) |
| ***C10M 139/00*** | (2006.01) |
| ***C10M 159/20*** | (2006.01) |
| ***C10M 159/22*** | (2006.01) |
| ***C10M 159/24*** | (2006.01) |
| ***C10M 169/04*** | (2006.01) |

(52) U.S. Cl.

CPC ..... *C10M 169/04* (2013.01); *C10M 105/04* (2013.01); *C10M 129/40* (2013.01); *C10M 135/10* (2013.01); *C10M 137/02* (2013.01); *C10M 139/00* (2013.01); *C10M 159/20* (2013.01); *C10M 159/22* (2013.01); *C10M 159/24* (2013.01); *C10M 2203/1025* (2013.01); *C10M 2205/0285* (2013.01); *C10M 2207/028* (2013.01); *C10M 2207/122* (2013.01); *C10M 2215/064* (2013.01); *C10M 2215/28* (2013.01); *C10M 2219/046* (2013.01); *C10M 2219/106* (2013.01); *C10M 2223/049* (2013.01); *C10N 2210/01* (2013.01); *C10N 2220/027* (2013.01); *C10N 2220/028* (2013.01); *C10N 2230/06* (2013.01); *C10N 2230/52* (2013.01); *C10N 2240/04* (2013.01); *C10N 2270/00* (2013.01)

(58) Field of Classification Search

CPC ..... C10M 2215/28; C10M 2219/046; C10M 2219/089

USPC ..... 508/192, 391, 574

See application file for complete search history.

(56) References Cited

U.S. PATENT DOCUMENTS

| | | | | |
|---|---|---|---|---|
| 3,652,410 | A | 3/1972 | Hollinghurst et al. | |
| 4,792,410 | A | 12/1988 | Schwind et al. | |
| 5,635,459 | A | 6/1997 | Stoffa et al. | |
| 6,503,872 | B1 | 1/2003 | Tomaro et al. | |
| 6,617,287 | B2 | 9/2003 | Gahagan et al. | |
| 7,238,651 | B2 | 7/2007 | Kocsis et al. | |
| 2006/0178278 | A1* | 8/2006 | Kocsis | C10M 159/20 508/390 |
| 2008/0119378 | A1* | 5/2008 | Gandon | C10M 159/24 508/390 |
| 2009/0203564 | A1 | 8/2009 | Seddon et al. | |
| 2010/0152080 | A1 | 6/2010 | Tipton et al. | |
| 2011/0136711 | A1 | 6/2011 | Wang et al. | |
| 2013/0274162 | A1* | 10/2013 | Friend | C10M 159/12 508/392 |

FOREIGN PATENT DOCUMENTS

| | | | |
|---|---|---|---|
| EP | 0094814 | A2 | 11/1983 |
| EP | 0552863 | A2 | 7/1993 |
| EP | 0987311 | A2 | 3/2000 |
| WO | 8705927 | A2 | 10/1987 |
| WO | 0026328 | | 5/2000 |
| WO | 2007120352 | A2 | 10/2007 |
| WO | 2012087775 | A1 | 6/2012 |

* cited by examiner

*Primary Examiner* — Vishal V Vasisth
(74) *Attorney, Agent, or Firm* — Iken Sans

(57) ABSTRACT

The invention provides a method of lubricating a transmission which includes a synchronizer with a non-metallic surface, the method comprising supplying thereto a lubricant comprising: (a) an oil of lubricating viscosity; (b) an alkaline earth metal detergent; and (c) a non-aromatic carboxylic acid or a salt thereof having 8 to 24 carbon atoms.

10 Claims, No Drawings

METHOD OF LUBRICATING A TRANSMISSION WHICH INCLUDES A SYNCHRONIZER WITH A NON-METALLIC SURFACE

CROSS REFERENCE TO RELATED APPLICATION

This application claims priority from PCT Application Serial No. PCT/US2014/047513 filed on Jul. 22, 2014, which claims the benefit of U.S. Provisional Application No. 61/860,310, filed on Jul. 31, 2013.

FIELD OF INVENTION

The invention relates to a method of lubricating a transmission which includes a synchronizer with a non-metallic surface, the method comprising supplying thereto a lubricant comprising: (a) an oil of lubricating viscosity; (b) an alkaline earth metal detergent; and (c) a non-aromatic carboxylic acid or a salt thereof having 8 to 24 carbon atoms.

BACKGROUND OF THE INVENTION

The present invention relates to lubricants for transmissions which include a synchronizer with a non-metallic surface. Such lubricants show improved performance with non-metal synchromesh components. Problems occur with synchromesh parts in transmissions which include a synchronizer with a non-metallic surface with many oils delivering a non-optimal friction.

A synchronizer is one of the more important components of manual and dual clutch transmissions. Increasing performance, reducing shift force and minimizing the between-the-gears energy losses are the primary objectives for a new generation of synchronizer systems. Improvements in the capacity of the mechanical system and the introduction of various synchronizers of various designs and materials are allowing economical re-engineering of existing synchronizer designs into more efficient designs. The lubricants or additives for manual and dual clutch transmission lubricating oils needs to be reformulated for these designs to be able to maintain adequate friction between the interacting parts of the synchronizer and to protect these parts from wear.

Conventional gear oils or manual transmission oils typically contain chemical components, such as active sulfur and surface-active amine organophosphates. While excellent as additives to provide extreme pressure lubrication, in the usual amounts these additives alone are typically too slippery and do not adequately protect the lubricated surfaces from abrasive or corrosive wear.

U.S. Pat. No. 6,503,872, Tomaro, Jan. 7, 2003, discloses extended drain manual transmission lubricants which contain at least one basic alkali or alkaline earth metal salt of an acidic organic compound. The overbased material generally have a total base number up to about 600 or about 500, or about 400. In Example 1, a manual transmission lubricant is prepared by blending into a manual transmission base stock, 1.2 parts of the Example A-6 [a metal dithiophosphate] with 0.4 parts of an oil solution of an overbased magnesium sulfonate (42% diluent oil, metal ratio 14.7, 9.4% magnesium, and 400 total base number) to form an intermediate, to this intermediate is added 0.5 parts of dibutyl phosphite. In other examples, a calcium sulfurized phenate (38% diluent oil, 255 total base number) is also present.

PCT publication WO 1987/05927, Oct. 8, 1987, discloses manual transmission fluids comprising, among other components, a selected alkaline earth metal salt. In Example IV, a manual transmission fluid is prepared by combining, with other ingredients, 3.5 parts calcium alkyl benzene sulfonate (overbased) wherein the alkyl contains about 24 carbon atoms on average. In a description of overbased salts, it states that typically, the excess alkaline earth metal will be present over that which is required to neutralize the anion at about 10:1 to 30:1, preferably 11:1 to 18:1 on an equivalent basis.

U.S. Pat. No. 6,617,287, Gahagan, Sep. 9, 2003, discloses manual transmission lubricants with improved synchromesh performance. Problems of wear and too low friction for a manual transmission with sintered metal parts in the synchronizer are said to be solved by using a lubricating oil formulated with a high level of an alkaline earth sulfonate in combination with amine phosphates. Preferred metal salts are magnesium or calcium, more preferably magnesium. The overbased materials generally have a total base number from about 20 to about 700, preferably from about 100 to about 600, and more preferably from about 250 to about 500. In examples, there is employed an overbased magnesium alkylbenzenesulfonate with a TBN of 400 and containing about 32% mineral oil diluent.

U.S. Patent Publication 2008/0119378, Gandon et al., May 22, 2008, discloses functional fluids comprising alkyl toluene sulfonates as friction modifying agents. The fluids may be tractor fluids, transmission fluids, or hydraulic fluids. The alkyl toluene sulfonate salts may be either neutral or overbased salts, and they may be highly overbased to have a TBN of between about 50 to about 400, or about 280 to about 350, or about 320.

European Patent Application EP 0 552 863, Jul. 28, 1993, discloses high-sulfur mineral oil compositions and reducing the copper corrosivity of mineral oils having a high content of sulfur compounds. Example 1 discloses an additive concentrate containing, among other components, 1.33% of an overbased calcium sulfurized phenate, indicted to have a TBN of 254, and 1.33% calcium dinonylnaphthalene sulfonate as a 50% solution in light mineral oil. The lubricating oil compositions can be used in a variety of applications such as automotive crankcase lubricating oils, automatic transmission fluids, gear oils, hydraulic oils, or cutting oils. The preferred application is as power transmission fluids, especially hydraulic oils.

U.S. Pat. No. 4,792,410, Schwind et al., Dec. 20, 1988, discloses a lubricant composition suitable for manual transmission fluids. Example II discloses a manual transmission fluid containing, among other components, 3.0 parts calcium alkyl benzene sulfonate (overbased). Example III includes 3.5 parts calcium sulfur coupled alkyl (C12) phenate overbased to 200 total base number.

PCT publication WO 2000/26328, May 11, 2000, discloses lubricants having overbased metal salts and organic phosphites. The lubricants may be used in manual transmissions. Example 1 discloses a lubricant prepared by blending (with other components) 0.7% of a calcium benzene sulfonate having 53% oil and a total base number of 41.

European Patent Application EP 0 987 311, Mar. 22, 2000, discloses transmission fluid compositions. A composition comprising an oil and (among other components) at least 0.1 percent by weight of an overbased metal salt provides an improved fluid for continuously variable transmissions. It is said that manual transmission fluids (among others) can benefit from incorporation of the components of that invention. Example 5 discloses a mixture of components including 0.3 parts overbased calcium sulfonate, including 0.1 part diluent oil (300 TBN). The suitable overbased materials themselves preferably have a total base number of 50 to 550, more preferably 100 to 450, on an oil free basis.

U.S. Pat. No. 3,652,410, Hollinghurst et al., Mar. 28, 1972, discloses lubricant compositions for a multipurpose lubricating oil that can be used for, among others, transmissions. Examples in Table I contain basic calcium sulfonate total base No. 300.

U.S. Pat. No. 7,238,651, Kocsis et al., Jul. 3, 2007, discloses a process for preparing an overbased detergent and the use of such a detergent in internal combustion engines. An example discloses the preparation of 500 TBN calcium sulfonate. The Total Base Number is described as a measure of the final overbased detergent containing the oil used in processing. Various optional performance additives may also be present.

U.S. Patent Publication 2010-0152080, Tipton et al., Jun. 17, 2010, discloses a lubricant composition exhibiting good dynamic frictional performance. The lubricant composition comprises an oil of lubricating viscosity and an oil-soluble branched-chain hydrocarbyl-substituted arenesulfonic acid salt having at least one hydrocarbyl substituent which is a highly branched group as defined by having a Chi(0)/Shadow XY ratio greater than about 0.180.

U.S. Pat. No. 5,635,459 (Stoffa et al., published 3 Jun. 1997) discloses functional fluid composition having improved gear performance comprises an oil of lubricating viscosity, and added thereto (a) an alkali or alkaline earth metal salt complex in the form of borated and/or non-borated salts; (b) an EP/antiwear agent comprising a mixture of zinc salts of dialkylphosphorodithioic acid and 2-ethylhexanoic acid heated with triphenyl phosphite or an olefin; and (c) a borated epoxide.

U.S Publication 2009/0203564, Seddon et al., Aug. 13, 2009, discloses a process for preparing a neutral or an overbased detergent. In certain embodiments, the detergent may have a TBN ranging from 100 to 1300, or from 250 to 920. The overbased detergent is said to be suitable for any lubricant composition; listed lubricants include transmission fluids and gear oils, among others.

Lubricants are known which provide a desirable friction for interaction with synchronizers. However, it is desirable to have a lubricant that has desirable friction shift characteristics (such as slope and curvature of engagement) compatible with the material of the synchronizer, but also a lubricant which is durable, such that the level of dynamic friction does not degrade but remains at a substantially constant level over a long period of the transmission being in use. The greater the durability of the friction properties of the lubricant, the wear of the synchronizer and therefore the lifespan of the synchronizer itself will be increased, along with optimized shift performance.

SUMMARY OF THE INVENTION

The present invention provides a method of lubricating a transmission which includes a synchronizer with a metallic or non-metallic surface (typically a non-metallic surface), the method comprising supplying thereto a lubricant. In particular, the lubricant aims to comprise a desirable friction co-efficient and durability for use with brass, molybdenum, phenolic resin, or carbon based synchronizers. In one embodiment the invention provides a method of lubricating a transmission which includes a synchronizer with a non-metallic surface, the method comprising supplying thereto a lubricant, wherein the synchronizer surface comprises carbon.

As used herein the term TBN is total base number (as measured by ASTM D2896) and has unit of mg KOH/g.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel, and essential characteristics of the composition or method under consideration.

The disclosed technology provides a method of lubricating a transmission which includes a synchronizer with a non-metallic surface, the method comprising supplying thereto a lubricant comprising: (a) an oil of lubricating viscosity; (b) an alkaline earth metal detergent; and (c) a non-aromatic carboxylic acid or a salt thereof having 8 to 24 carbon atoms. In certain embodiments, at least one lubricated surface in the synchronizer comprises carbon as the primary constituent. The transmission which includes a synchronizer may be a manual transmission or a dual clutch transmission, typically a manual transmission.

The amount of non-aromatic carboxylic acid in the lubricant is 0.01 to 2 wt %, or 0.02 to 1 wt %, or 0.05 to 0.75 wt %, or 0.05 to 0.5 wt % of the lubricating composition. In one embodiment the amount of non-aromatic carboxylic acid in the lubricant is 0.05 to 0.2 wt % of the lubricating composition.

The alkaline earth metal detergent may have a metal ratio in the range of 10 to 40, or 11 to 30, or 12 to 25. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio is also explained in standard textbook entitled "Chemistry and Technology of Lubricants", Third Edition, Edited by R. M. Mortier and S. T. Orszulik, Copyright 2010, page 219, sub-heading 7.25.

The alkaline earth metal detergent on an oil containing basis may have a TBN ranging from 250 to 500, with a metal ratio ranging from 10 to 35. For example, the alkaline earth metal detergent in different embodiments may have a TBN of 300, and a metal ratio of 12.3; or the TBN may be 400, and a metal ratio of 22.4.

DETAILED DESCRIPTION OF THE INVENTION

Various preferred features and embodiments will be described below by way of non-limiting illustration.

The lubricant employed in lubricating a transmission which includes a synchronizer with a non-metallic surface will contain an oil of lubricating viscosity, also referred to as a base oil. The base oil may be selected from any of the base oils in Groups I-V of the American Petroleum Institute (API) Base Oil Interchangeability Guidelines, namely

| Base Oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |

-continued

| Base Oil Category | Sulfur (%) | | Saturates (%) | Viscosity Index |
|---|---|---|---|---|
| Group III | ≤0.03 | and | ≥90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity can include natural or synthetic oils and mixtures thereof. A mixture of mineral oil and synthetic oil, e.g., polyalphaolefin oils and/or polyester oils, may be used. In certain embodiments the oil employed is a mineral oil base stock and may be one or more of Group I, Group II, and Group III base oils or mixtures thereof. In certain embodiments the oil is not a synthetic oil. In certain embodiments the oil is Group I, Group II, Group III, or mixtures thereof.

Natural oils include animal oils and vegetable oils (e.g. vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are also useful oils of lubricating viscosity. Oils of lubricating viscosity derived from coal or shale are also useful.

Synthetic oils include hydrocarbon oils and halosubstituted hydrocarbon oils such as polymerized and interpolymerized olefins and mixtures thereof, alkylbenzenes, polyphenyl, alkylated diphenyl ethers, and alkylated diphenyl sulfides and their derivatives, analogs and homologues thereof. Alkylene oxide polymers and interpolymers and derivatives thereof, and those where terminal hydroxyl groups have been modified by, e.g., esterification or etherification, are other classes of synthetic lubricating oils.

Other suitable synthetic lubricating oils comprise esters of dicarboxylic acids and those made from $C_5$ to $C_{12}$ monocarboxylic acids and polyols or polyol ethers. Other synthetic lubricating oils include liquid esters of phosphorus-containing acids, polymeric tetrahydrofurans, silicon-based oils such as poly-alkyl-, polyaryl-, polyalkoxy-, or polyaryloxy-siloxane oils, and silicate oils.

Other synthetic oils include those produced by Fischer-Tropsch reactions, typically hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures thereof) of the types disclosed hereinabove can be used. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Rerefined oils often are additionally processed to remove spent additives and oil breakdown products.

In one embodiment the oil of lubricating viscosity may be an API Group I to IV mineral oil, an ester or a synthetic oil, or mixtures thereof.

The amount of the oil of lubricating viscosity present is typically the balance remaining after subtracting from 100 wt % the sum of the amount of the alkaline earth metal detergent and the non-aromatic carboxylic acid or a salt thereof having 8 to 24, or 10 to 20 carbon atoms described in greater detail hereinafter and the other performance additives that may be present.

Another component of the disclosed lubricant is an overbased, carbonated calcium arylsulfonate detergent having a total base number of 250 to 500. For example, the overbased, carbonated calcium arylsulfonate detergent may have a TBN of at least 640 as calculated on an oil-free basis (or 400 TBN oil containing), or a mixture of such detergents. Detergents in general are typically overbased materials, otherwise referred to as overbased or superbased salts, which are generally homogeneous Newtonian systems having by a metal content in excess of that which would be present for neutralization according to the stoichiometry of the metal and the detergent anion.

While it is required that an overbased sulfonate detergent be present (typically an overbased calcium sulfonate detergent), other metals may also be present, whether in a sulfonate detergent (for example, an overbased magnesium arylsulfonate detergent) or a different detergent substrate (for example, an overbased calcium phenate detergent). The metal compounds generally useful in making the basic metal salts are generally any Group 1 or Group 2 metal compounds (CAS version of the Periodic Table of the Elements). Examples include alkali metals such as sodium, potassium, lithium; copper; magnesium; calcium; barium; zinc; and cadmium.

In one embodiment the metals are sodium, magnesium, or calcium. The anionic portion of the salt can be hydroxide, oxide, carbonate, borate, or nitrate. The detergents of particular interest for the present technology will be calcium detergents, typically prepared using calcium oxide or calcium hydroxide. Since the detergents of particular interest are carbonated detergents, they will be materials that have been treated with carbon dioxide. Such treatment leads to more efficient incorporation of basic metal into the composition. Formation of high TBN detergents involving reaction with carbon dioxide is disclosed, for instance, in U.S. Pat. No. 7,238,651, Kocsis et al., Jul. 3, 2007, see, for instance, examples 10-13 and the claims. Other detergents, however, may also optionally be present, which need not be carbonated or need not be so highly overbased (i.e., of lower TBN). For example the lubricant may comprise an overbased calcium arylsulfonate detergent and a neutral or overbased detergent different from the calcium arylsulfonate detergent. A neutral detergent has a metal ratio of about 1 to 1.3, or 1 to 1.1. However, if multiple detergents are present, it is desirable that the overbased calcium arylsulfonate detergent is present as the predominant amount by weight of the metal detergents, that is, at least 50 weight percent or at least 60 or 70 or 80 or 90 weight percent of the metal-containing detergents, on an oil free basis.

The lubricants useful in the present technology will contain an overbased sulfonate detergent. Suitable sulfonic acids include sulfonic and thiosulfonic acids, including mono- or polynuclear aromatic or cycloaliphatic compounds. Certain oil-soluble sulfonates can be represented by $R^2$-T-$(SO_3^-)_a$ or $R^3$—$(SO_3^-)_b$, where a and b are each at least one; T is a cyclic nucleus such as benzene or toluene; $R^2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms.

The groups T, $R^2$, and $R^3$ can also contain other inorganic or organic substituents; they may also be described as hydrocarbyl groups. In one embodiment the sulfonate detergent may be a predominantly linear alkylbenzenesulfonate detergent. In some embodiments the linear alkyl (or hydrocarbyl) group may be attached to the benzene ring anywhere along the linear chain of the alkyl group, but often in the 2, 3, or 4 position of the linear chain, and in some instances predominantly in the 2 position. In other embodiments, the alkyl (or hydrocarbyl) group may be branched, that is, formed from a branched olefin such as propylene or 1-butene or isobutene. Sulfonate detergents having a mixture of linear and branched alkyl groups may also be used.

In certain embodiments the carbonated calcium arylsulfonate detergent of the disclosed technology may be based on an alkylated and sulfonated benzene; in another embodiment, it may be based on an alkylated and sulfonated toluene. In either case there may be one or two or three, and in certain embodiments one, alkyl (or hydrocarbyl) group attached to the aromatic ring, in addition to the methyl group if toluene is used as the starting aromatic compound.

In one embodiment, the detergent is a monoalkylbenzenemonosulfonate, and in another embodiment it is a monoalkyltoluenemonosulfonate. If there is one aromatic group, it may contain a sufficient number of carbon atoms to impart oil-solubility to the detergent, such as at least 8 carbon atoms, or 10 to 100 carbon atoms, or 10 to 50 carbon atoms, or 12 to 36 carbon atoms, or 14 to 24 or 16 to 20 or alternatively about 18 carbon atoms. If more than one alkyl group (other than methyl) is present, each alkyl group may have the afore-described number of carbon atoms, or all the alkyl groups together may have in total the afore-described number of carbon atoms, (e.g., two C12 alkyl groups for a total of 24 carbon atoms in the alkyl groups).

Another type of overbased material that may additionally be present (that is, in addition to the arylsulfonate detergent) in certain embodiments of the present invention is an overbased phenate detergent. Certain commercial grades of calcium sulfonate detergents contain minor amounts of calcium phenate detergents to aid in their processing or for other reasons and may contain, for instance, 4% phenate substrate content and 96% sulfonate substrate content.

The phenols useful in making phenate detergents can be represented by $(R^1)_a$—Ar—$(OH)_b$, where $R^1$ is an aliphatic hydrocarbyl group of 4 to 400 or 6 to 80 or 6 to 30 or 8 to 25 or 8 to 15 carbon atoms; Ar is an aromatic group such as benzene, toluene or naphthalene; a and b are each at least one, the sum of a and b being up to the number of displaceable hydrogens on the aromatic nucleus of Ar, such as 1 to 4 or 1 to 2. There is typically an average of at least 7 or 8 aliphatic carbon atoms provided by the $R^1$ groups for each phenol compound, and in some instances about 12 carbon atoms.

Phenate detergents are also sometimes provided as sulfur-bridged species or as methylene-bridged species. Sulfur-bridged species may be prepared by reacting a hydrocarbyl phenol with sulfur. Methylene-bridged species may be prepared by reacting a hydrocarbyl phenol with formaldehyde (or a reactive equivalent such as paraformaldehyde). Examples include sulfur-bridged dodecylphenol (overbased Ca salt) and methylene-coupled heptylphenol.

In another embodiment, an optional, additional overbased material is an overbased saligenin detergent. Overbased saligenin detergents are commonly overbased magnesium salts which are based on saligenin derivatives. A general example of such a saligenin derivative can be represented by the formula:

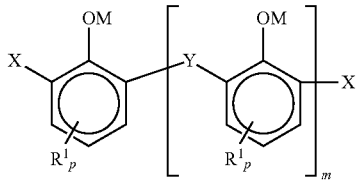

where X is —CHO or —$CH_2OH$, Y is —$CH_2$— or —$CH_2OCH_2$—, and the —CHO groups typically comprise at least 10 mole percent of the X and Y groups; M is hydrogen, ammonium, or a valence of a metal ion (that is, if M is multivalent, one of the valences is satisfied by the illustrated structure and other valences are satisfied by other species such as anions or by another instance of the same structure), $R^1$ is a hydrocarbyl group of 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion or a mixture of Mg and hydrogen. Saligenin detergents are disclosed in greater detail in U.S. Pat. No. 6,310,009, with special reference to their methods of synthesis (Column 8 and Example 1) and preferred amounts of the various species of X and Y (Column 6).

Other optional detergents include salixarate detergents. Salixarate detergents are overbased materials that can be represented by a compound comprising at least one unit of formula (I) or formula (II):

(II)

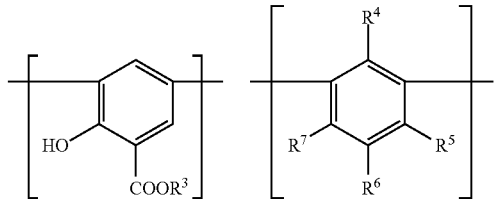

each end of the compound having a terminal group of formula (III) or (IV):

(III)

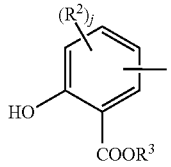

(IV)

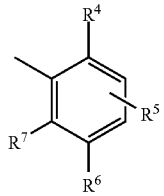

such groups being linked by divalent bridging groups A, which may be the same or different. In formulas (I)-(IV) $R^3$ is hydrogen, a hydrocarbyl group, or a valence of a metal ion; $R^2$ is hydroxyl or a hydrocarbyl group, and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is 0.1:1 to 2:1. The divalent bridging group "A," which may be the same or different in each occurrence, includes —$CH_2$— and —$CH_2OCH_2$—, either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate." In one embodiment, a salixarate detergent may contain a portion of molecules represented (prior to neutralization) by the structure

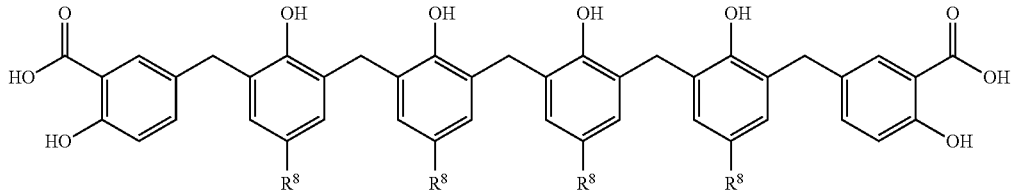

where the $R^8$ groups are independently hydrocarbyl groups containing at least 8 carbon atoms.

Glyoxylate detergents are also optional overbased materials. They are based on an anionic group which, in one embodiment, may have the structure

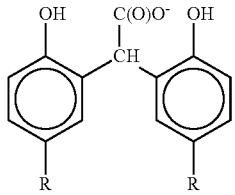

wherein each R is independently an alkyl group containing at least 4 or 8 carbon atoms, provided that the total number of carbon atoms in all such R groups is at least 12 or 16 or 24. Alternatively, each R can be an olefin polymer substituent. The acidic material upon from which the overbased glyoxylate detergent is prepared is the condensation product of a hydroxyaromatic material such as a hydrocarbyl-substituted phenol with a carboxylic reactant such as glyoxylic acid or another omega-oxoalkanoic acid. Overbased glyoxylic detergents and their methods of preparation are disclosed in greater detail in U.S. Pat. No. 6,310,011 and references cited therein.

Another optional overbased detergent is an overbased salicylate, e,g., an alkali metal or alkaline earth metal salt of a substituted salicylic acid. The salicylic acids may be hydrocarbyl-substituted wherein each substituent contains an average of at least 8 carbon atoms per substituent and 1 to 3 substituents per molecule. The substituents can be polyalkene substituents. In one embodiment, the hydrocarbyl substituent group contains 7 to 300 carbon atoms and can be an alkyl group having a molecular weight of 150 to 2000. Overbased salicylate detergents and their methods of preparation are disclosed in U.S. Pat. Nos. 4,719,023 and 3,372,116.

Other optional overbased detergents can include overbased detergents having a Mannich base structure, as disclosed in U.S. Pat. No. 6,569,818.

In certain embodiments, the hydrocarbyl substituents on hydroxy-substituted aromatic rings in the above detergents (e.g., phenate, saligenin, salixarate, glyoxylate, or salicylate) are free of or substantially free of $C_{12}$ aliphatic hydrocarbyl groups (e.g., less than 1%, 0.1%, or 0.01% by weight of the substituents are $C_{12}$ aliphatic hydrocarbyl groups). In some embodiments such hydrocarbyl substituents contain at least 14 or at least 18 carbon atoms.

The amount of the overbased carbonated calcium arylsulfonate detergent in the formulations of the present technology is typically at least 0.1 weight percent, e.g., 0.14 to 4 percent by weight, about 0.14 percent to about 4 percent by weight, or 0.2 to 3.5 percent by weight, or 0.5 to 3 percent by weight, or 1 to 2 percent by weight. Alternative amounts include 0.5 to 4 percent, 0.6 to 3.5 percent, 1.0 to 3 percent, or 1.5 to 2.8%, e.g. at least 1.0 percent. One or a plurality of overbased carbonated calcium arylsulfonate detergents may be present, and if more than one is present, the total amount of such materials may be within the aforementioned percentage ranges. The amount of calcium provided to the lubricant by such materials will depend, of course, on the extent of overbasing of the detergent or detergents, but in some embodiments the amount of calcium provided may be 0.03 to 1.0 percent by weight, or 0.1 to 0.6 percent by weight, or, 0.2 to 0.5 percent by weight.

Any optional, additional detergents may be present in similar amounts. That is, in certain embodiments there may be an overbased phenate detergent present, which may optionally be a calcium phenate and which may optionally be a carbonated detergent, e.g., an overbased carbonated calcium phenate. It may also be a sulfur-bridged material. The amount of such material, if it is present, may be 0 to 4 percent, or 0.05 to 4 percent, 0.1 to 4 percent, or 0.5 to 4 percent, or 1 to 3 percent, or 1.5 to 2.8 percent by weight, or, alternatively 0.05 to 0.1 percent. Likewise, in certain embodiments there may be an overbased magnesium sulfonate detergent present. It may optionally be a carbonated detergent, e.g., an overbased carbonated magnesium arylsulfonate, based on any of the sulfonic acids earlier described. The amount of such material, if it is present, may be 0 to 4 percent, or 0.05 to 4 percent, 0.1 to 4 percent, or 0.5 to 4 percent, or 1 to 3 percent, or 1.5 to 2.8 percent by weight.

As used in this document, expressions such as "represented by the formula" indicate that the formula presented is generally representative of the structure of the chemical in question. However, minor variations can occur, such as positional isomerization. Such variations are intended to be encompassed.

In addition to the oil of lubricating viscosity and the overbased detergent or detergents, the present lubricants will typically include various other additives that may be used in manual transmission fluids. One such material is a phosphorus-containing material that may serve as an antiwear agent or may provide other benefits.

The phosphorus-containing material may include at least one phosphite. In one embodiment, the phosphite is a di- or trihydrocarbyl phosphite, and in one embodiment it may be a dialkylphosphite. The phosphite may be present in an amount of 0.05 to 3, or 0.2 to 2, or 0.2 to 1.5, or 0.05 to 1.5, or 0.1 to 1, or 0.2 to 0.7 percent by weight. The hydrocarbyl or alkyl groups may have 1 to 24, or 1 to 18, or 2 to 8 carbon atoms. Each hydrocarbyl group may independently be alkyl, alkenyl, aryl, or mixtures thereof. When the hydrocarbyl group is an aryl group, it will contain at least 6 carbon atoms, e.g., 6 to 18 carbon atoms. Examples of alkyl or alkenyl groups include propyl, butyl, pentyl, hexyl, heptyl octyl, oleyl, linoleyl, and stearyl groups. Examples of aryl groups include phenyl and naphthyl groups and substituted aryl groups such as heptylphenyl groups. Phosphites and their preparation are known, and many phosphites are available commercially. Particularly useful phosphites include dibutyl hydrogen phosphite, dioleyl phosphite, di($C_{14-18}$) phosphite, and triphenyl phosphite. In one embodiment, the phosphorus component is a dialkylphosphite.

Another phosphorus containing material may include a metal salt of a phosphorus acid. Metal salts of the formula:

$$[(R^8O)(R^9O)P(=S)—S]_n\text{-}M$$

where $R^8$ and $R^9$ are independently hydrocarbyl groups containing 3 to 30 carbon atoms, are readily obtainable by heating phosphorus pentasulfide ($P_2S_5$) and an alcohol or phenol to form an O,O-dihydrocarbyl phosphorodithioic acid. The alcohol which reacts to provide the $R^8$ and $R^9$ groups may be a mixture of alcohols, for instance, a mixture of isopropanol and 4-methyl-2-pentanol, and in some embodiments a mixture of a secondary alcohol and a primary alcohol, such as isopropanol and 2-ethylhexanol. The resulting acid may be reacted with a basic metal compound to form the salt. The metal M, having a valence n, generally is aluminum, tin, manganese, cobalt, nickel, zinc, or copper, and in many cases, zinc, to form zinc dialkyldithiophosphates. Such materials are well known and readily available to those skilled in the art of lubricant formulation. Suitable variations to provide low phosphorus volatility are disclosed, for instance, in US published application 2008-0015129, see, e.g., claims.

Yet another type of a phosphorus antiwear agent may include an amine salt of a phosphorus acid ester. This material can serve as one or more of an extreme pressure agent and a wear preventing agent. The amine salt of a phosphorus acid ester may include phosphoric acid esters and salts thereof; dialkyldithiophosphoric acid esters and salts thereof; phosphites; and phosphorus-containing carboxylic esters, ethers, and amides; and mixtures thereof. The amine salt of the phosphorus acid ester may comprise any of a variety of chemical structures. In particular, a variety of structures are possible when the phosphorus acid ester compound contains one or more sulfur atoms, that is, when the phosphorus-containing acid is a thiophosphorus acid ester, including mono- or dithiophosphorus acid esters. A phosphorus acid ester may be prepared by reacting a phosphorus compound such as phosphorus pentoxide with an alcohol. Suitable alcohols include those containing up to 30 or to 24, or to 12 carbon atoms, including primary or secondary alcohols such as isopropyl, butyl, amyl, sec-amyl, 2-ethylhexyl, hexyl, cyclohexyl, octyl, decyl and oleyl alcohols and mixtures of isomers thereof, as well as any of a variety of commercial alcohol mixtures having, e.g., 8 to 10, 12 to 18, or 18 to 28 carbon atoms. Polyols such as diols may also be used. The amines which may be suitable for use as the amine salt include primary amines, secondary amines, tertiary amines, and mixtures thereof, including amines with at least one hydrocarbyl group, or, in certain embodiments, two or three hydrocarbyl groups having, e.g., 2 to 30 or 8 to 26 or 10 to 20 or 13 to 19 carbon atoms.

In certain embodiments a phosphorus antiwear agent may be present in an amount to deliver 0.01 to 0.2 or 0.015 to 0.15 or 0.02 to 0.1 or 0.025 to 0.08 percent phosphorus to the lubricant.

The lubricant formulation will typically also contain at least one dispersant. Dispersants are well known in the field of lubricants and include primarily what are known as ashless dispersants and polymeric dispersants. Ashless dispersants are so-called because, as supplied, they do not contain metal and thus do not normally contribute to sulfated ash when added to a lubricant. However they may, of course, interact with constituent metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically:

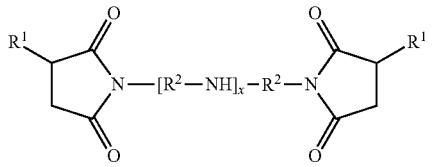

where each $R^1$ is independently an alkyl group, frequently a polyisobutylene group with a molecular weight ($M_n$) of 500-5000 based on the polyisobutylene precursor, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. In the above structure, the amine portion is shown as an alkylene polyamine, although other aliphatic and aromatic mono- and polyamines may also be used. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials may have the general structure

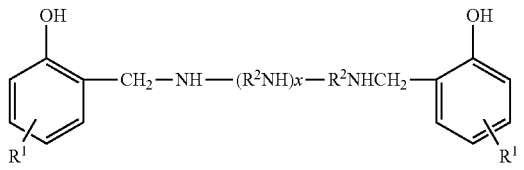

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can be and often are post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. In certain embodiments, a dispersant is used and is a borated dispersant, such as a borated succinimide dispersant. In certain embodiments, the dispersant is post-treated with an acid such as terephthalic acid, thus for instance a terephthalic acid treated succinimide dispersant. In certain embodiments, the dispersant is treated with at least one of a boron compound and terephthalic acid. Dispersants of this type (which may also optionally be further treated with other materials such as a dimercaptothiadiazole) are disclosed in greater detail in U.S. Pat. No. 7,902,130, Baumanis et al, Mar. 8, 2011; see, for instance, Example 1 thereof.

The amount of the dispersant in a fully formulated lubricant of the present technology may be at least 0.1% of the lubricant composition, or at least 0.3% or 0.5% or 1%, and in certain embodiments at most 5% or 4% or 3% or 2% by weight.

Another component that may be present is an antioxidant. Antioxidants encompass phenolic antioxidants, which may comprise a butyl substituted phenol containing 2 or 3 t-butyl groups. The para position may also be occupied by a hydrocarbyl group, an ester-containing group, or a group bridging two aromatic rings. Antioxidants also include aromatic amine, such as nonylated diphenylamines, phenyl-α-naphthylamine ("PANA"), or alkylated phenylnaphthylamine. Other antioxidants include sulfurized olefins, titanium compounds, and molybdenum compounds. U.S. Pat. No. 4,285,822, for instance, discloses lubricating oil compositions containing a molybdenum and sulfur containing composition. U.S. Patent Application Publication 2006-0217271 discloses a variety of titanium compounds, including titanium alkoxides and titanated dispersants, which materials may also impart improvements in deposit control and filterability. Other titanium compounds include titanium carboxylates such as neodecanoate. Typical amounts of antioxidants will, of course, depend on the specific antioxidant and its individual effectiveness, but illustrative total amounts can be 0.01 to 5 percent by weight or 0.15 to 4.5 percent or 0.2 to 4 percent. Additionally, more than one antioxidant may be present, and certain combinations of these can be synergistic in their combined overall effect.

Viscosity improvers (also sometimes referred to as viscosity index improvers or viscosity modifiers) may be included in the compositions of this technology. Viscosity improvers are usually polymers, including polyisobutenes, polymethacrylic acid esters, diene polymers, polyalkylstyrenes, esterified styrene-maleic anhydride copolymers, alkenylarene-conjugated diene copolymers, and polyolefins. Multifunctional viscosity improvers, which also have dispersant and/or antioxidancy properties are known and may optionally be used.

Another additive is an antiwear agent, in addition to those described above. Examples of anti-wear agents include phosphorus-containing antiwear/extreme pressure agents such as metal thiophosphates, phosphoric acid esters and salts thereof, phosphorus-containing carboxylic acids, esters, ethers, and amides; and phosphites. Non-phosphorus-containing anti-wear agents include borate esters (including borated epoxides), dithiocarbamate compounds, molybdenum-containing compounds, and sulfurized olefins.

Other materials that may be used as antiwear agents include tartrate esters, tartramides, and tartrimides. Examples include oleyl tartrimide (the imide formed from oleylamine and tartaric acid) and oleyl or other alkyl diesters (from, e.g., mixed C12-16 alcohols). Other related materials that may be useful include esters, amides, and imides of other hydroxy-carboxylic acids in general, including hydroxy-polycarboxylic acids, for instance, acids such as tartaric acid, citric acid, lactic acid, glycolic acid, hydroxypropionic acid, hydroxyglutaric acid, and mixtures thereof. These materials may also be used in formulations that contain phosphorus compounds, e.g., low-phosphorus oils. These materials may also impart additional functionality to a lubricant beyond antiwear performance. They are described in greater detail in US Publication 2006-0079413 and PCT publication WO2010/077630. Such derivatives of (or compounds derived from) a hydroxy-carboxylic acid, if present, may typically be present in the lubricating composition in an amount of 0.1 weight % to 5 weight %, or 0.2 weight % to 3 weight %, or greater than 0.2 weight % to 3 weight %.

Other additives that may optionally be used in lubricating oils include pour point depressing agents, extreme pressure agents, anti-wear agents, color stabilizers, and anti-foam agents.

The lubricant formulations described herein are effective for lubricating transmissions having synchronizers with a component made from a wide variety of non-metals and therefore having at least one surface made from such materials. Among the materials that may be used are carbon fibers, graphitic carbon materials, cellulosic materials, which may be typically present as a part of a composite in a resinous matrix, and phenolic resins. In certain embodiments the non-metallic material may be present on the surface of another substrate material, which may be resinous, cellulosic, or metallic, or combinations thereof. In some embodiments the non-metallic surface may be of a thickness of at least 1 micrometer, such as, greater than a few (up to 100) atoms in thickness. In some embodiments a synchronizer surface may be of a non-metallic substance in which particles of metal may be embedded; such materials may be considered to be non-metallic for purposes of the present technology. In a synchronizer, one mating component (typically, the gear cone) is made of steel and the other component or surface (typically, the synchronizer ring) is made of, or has a surface of, one of the foregoing materials. Another surface which may optionally also be present may include a metallic material such as solid brass, sintered brass, bronze (including solid bronze and sintered bronze), molybdenum, and aluminum.

The non-aromatic carboxylic acid or a salt thereof may be co-solubilised with the alkaline earth metal detergent in a process such as U.S. Patent Application 61/737,867 filed 17 Dec. 2012 by Cook, Friend, Walker and Dohner. The alkaline earth metal detergent disclosed therein may be prepared by contacting a non-aromatic carboxylic acid or a salt thereof and an alkaline earth metal detergent during formation of the detergent. The alkaline earth metal detergent and the non-aromatic carboxylic acid or a salt thereof may be contacted during a process for preparing an overbased metal detergent in an oil medium comprising the steps of:

(1) providing an organic acid selected from a group consisting of:
   a hydrocarbyl-substituted organic sulfonic acid,
   a mixture of a hydrocarbyl-substituted organic sulfonic acids,
   a metal salt of said organic acid, and
   mixtures thereof,
(2) further providing at least one mono-alcohol;
(3) further providing a basic metal compound;
(4) further providing a carboxylic acid having 6 to 30 carbon atoms
(5) reacting the mixture of step (4) with carbon dioxide to form a carbonated overbased metal sulfonate;

wherein the resultant overbased metal detergent has a metal metal ratio of 5:1 to 27:1, or 12 to 25.

Without being bound by theory if the alkaline earth metal detergent; and a non-aromatic carboxylic acid or a salt thereof having 8 to 24 carbon atoms defined by the present invention are provided by the alkaline earth metal detergent of this process the non-aromatic carboxylic acid may for instance be bound in equilibrium to a metal ion (such as calcium or magnesium, typically calcium) to form the overbased material and having the non-aromatic carboxylic acid in the salt form e.g., metal carboxylate of the non-aromatic carboxylic acid.

Typically the amount of non-aromatic carboxylic acid or a salt thereof in the alkaline earth metal detergent may be up to about 10 percent by weight, about 7 to 9 percent by weight.

The detergent prepared by contacting the alkaline earth metal detergent and the non-aromatic carboxylic acid or a salt thereof during production as described in U.S. Patent Application 61/737,867 may then deliver the non-aromatic carboxylic acid or a salt component in to a lubricant in an amount of 0.01 to 2 wt %, or 0.02 to 1 wt %, or 0.05 to 0.75 wt %, or 0.05 to 0.5 wt % of the lubricating composition. In one embodiment the amount of non-aromatic carboxylic acid in the lubricant is 0.05 to 0.2 wt % of the lubricating composition.

Alternatively, the non-aromatic carboxylic acid or a salt thereof may be premixed with the alkaline earth metal detergent. Alternatively, the lubricant containing the alkaline earth metal detergent may be top treated with the non-aromatic carboxylic acid or a salt thereof.

In one embodiment, the alkaline earth metal detergent is co-solubilised with a non-aromatic carboxylic acid for example, an alkyl or alkenyl fatty acid having 8 to 24 carbon atoms. The non-aromatic carboxylic acid may be stearic acid. However other types of acid may also be used such as capric acid, decanoic acid, decenoic acid, dodecanoic acid, dodecenoic acid, lauric acid, myristic acid, palmitic acid, oleic acid, stearic acid, or mixtures thereof. Typically the non-aromatic carboxylic acid may be oleic acid, stearic acid, or mixtures thereof. By co-solubilising an alkaline earth metal detergent with a non-aromatic carboxylic acid, the resultant lubricant produced properties of a desired friction and a durability of friction when tested with an carbon synchronizer over a duration of a number of cycles.

The following examples provide illustrations of the invention. These examples are non-exhaustive and are not intended to limit the scope of the invention.

EXAMPLES

A comparative Example 1 (CE1) contains PAO-100 base oil, a borated succinimide dispersant, bis(4-nonylphenyl) amine, 5-bis(nonyldisulfanyl)-1,3,4-thiadiazole and dibutylhydrogen phosphite and no detergent and no stearic acid.

A comparative Example 2 (CE2) contains PAO-100 base oil, a borated succinimide dispersant, bis(4-nonylphenyl) amine, 5-bis(nonyldisulfanyl)-1,3,4-thiadiazole and dibutylhydrogen phosphite, no detergent and 0.09 wt % stearic acid.

A comparative Example 3 (CE3) contains PAO-100 base oil, a borated succinimide dispersant, bis(4-nonylphenyl) amine, 5-bis(nonyldisulfanyl)-1,3,4-thiadiazole and dibutylhydrogen phosphite and 0.58 wt % a 400 TBN ethylene derived calcium sulphonate detergent (metal ratio of about 22.4), and no stearic acid.

An Inventive Example (IE1) contains PAO-100 base oil, a borated succinimide dispersant, bis(4-nonylphenyl)amine, 5-bis(nonyldisulfanyl)-1,3,4-thiadiazole and dibutylhydrogen phosphite and 0.58 wt % of a 400 TBN ethylene derived calcium sulphonate detergent (metal ratio of about 22.4), and 0.53 wt % of stearic acid.

An Inventive Example (IE2) contains PAO-100 base oil, a borated succinimide dispersant, bis(4-nonylphenyl)amine, 5-bis(nonyldisulfanyl)-1,3,4-thiadiazole and dibutylhydrogen phosphite and a 400 Total Base Number (TBN) ethylene derived calcium sulphonate detergent co-solubilized with 8% stearic acid (as is described in U.S. Patent Application 61/737,867 example 5, except the amount of stearic acid added in each step is uptreated to ensure the detergent has 8.19% rather than 7% reported in example 5.). The sulphonate detergent is present in an amount sufficient to deliver 0.53 wt % of stearic acid to the lubricant; and the metal ratio is about 22.4.

Formulations are prepared and tested in a synchronizer test rig in a "durability test." This is a screening test that is customarily used to evaluate friction and durability characteristic of a clutch synchronizer. The test rig typically does not simulate a full engagement of the synchronizer components, but does measure the friction between the synchronizer ring and the gear cone. The rig comprises a test rig bath in which the components are assembled.

An Automax® rig comprises a test rig bath in which the components are assembled. The synchronizer is attached to the test rig key on one side of the chamber and the cone assembled onto a test rig jig on the other side. The test conditions used are shown in the Table below. The fluids are maintained at 80° C. with the synchronizer typically rotating at 1000 rpm. In each test, there is an initial break-in phase of 100 cycles of engagement. Thereafter, multiple cycles of engagement consist of 0.2 seconds of contact followed by 5 seconds of separation, running at 1000 r.p.m. at 80° C. and a load during contact of 981 N (100 kg).

| | | |
|---|---|---|
| Oil Temperature | (° C.) | 80 |
| Speed | (rpm) | 1000 |
| Load | (kg) | 100 |
| | (N) | 980.6 |
| On Time | (sec) | 0.2 |
| Off Time | (sec) | 5.0 |
| Inertia | (kg cm $sec^2$) | 2.67 |
| Calculated Torque | (Nm) | 41 |

The key features of the synchronizer used in this experiment are summarized in the table below. All other parts are original equipment manufacturer production parts used in standard vehicles:

| | Carbon Composite Synchronizer |
|---|---|
| Gear Cone Angle (degrees) | 7.0 |
| Land Width (mm) | 10.02 |
| Effective radius (mm) | 78.5 |
| Composition | carbon composite |

The data from the test provides several key parameters that allow a comparison of the friction performance of the candidates. Comparisons of the relative durability and shift quality of the different candidates are made based upon a number of parameters including dynamic friction level assessed by the friction value during durability testing, friction durability assessed by the stability, and trends in average friction values during the durability phase.

Shift quality is assessed by examining the performance test profiles which show the variation of friction with rotational speed. It is desirable to have a flat frictional profile, with a level or slight decrease in friction at low speed providing improved synchroniser engagement and improved shift quality.

The dynamic coefficient of friction may be presented as a function of cycle number. A quantitative representation of the performance may be obtained by calculating the number of cycles to stability. Ideally, a fluid should show stable friction throughout the duration of the test. Some fluids may vary in friction at the start of the test, before stabilising to a final value after a number of cycles. Other fluids may not stabilize at all and the friction may be still increasing or decreasing after 10,000 cycles. One method of assessing dynamic friction is to evaluate the mean and standard deviation of the friction values during the 10,000 cycle test.

In order to assess the shift-quality of an individual engagement it is necessary to evaluate the friction versus speed relationship. One method parameter that is useful is to assess the curvature of the speed-friction relationship. In order to do this a chord is drawn between the μ values at 50 and 1000 rpm. The area of the difference between the actual $\mu_d$ and the chord gives a value that we will refer to as the curvature of the line. A large negative curvature value represents a poor result and a value that is close to zero or positive, indicates a better performance.

The other summary statistic used in evaluating a performance curve is the overall slope of the line, calculated from a linear regression. For tests where the curvature is far from zero, the regression line itself is clearly a poor fit. However, the slope of this line still indicates whether friction has risen sharply as speed is decreased. The results obtained for CE1 to CE3 and IE1 to 1E2 are:

| | CE1 | CE2 | CE3 | IE1 | IE2 |
|---|---|---|---|---|---|
| Durability cycle 1 | 0.128 | 0.128 | 0.125 | 0.125 | 0.12 |
| Durability cycle 1000 | 0.12 | 0.123 | 0.124 | 0.123 | 0.119 |
| Durability cycle 5000 | 0.118 | 0.12 | 0.121 | 0.122 | 0.118 |
| Durability cycle 10000 | 0.116 | 0.118 | 0.121 | 0.121 | 0.118 |
| Static Friction $\mu_s$/ (after durability) | 0.163 | 0.155 | 0.136 | 0.129 | 0.122 |
| Dynamic friction 1000 rpm (after durability) | 0.121 | 0.122 | 0.122 | 0.123 | 0.119 |
| $\mu_s/\mu_d$ | 1.347 | 1.270 | 1.032 | 1.049 | 1.025 |
| curvature | −4.6602 | −5.7569 | −2.212 | −1.186 | 0.805 |
| Slope ($\times 10^{-5}$) | −2.40 | −2.23 | −1.98 | −1.45 | −1.80 |
| mean dynamic friction | 0.118 | 0.120 | 0.122 | 0.122 | 0.118 |
| SD of friction | 0.00121 | 0.00207 | 0.00102 | 0.00060 | 0.00023 |

Footnote:
$\mu_s/\mu_d$ is static to dynamic friction ratio
SD is standard deviation Experimental data shows that in testing of carbon composite synchronizers with a predominately non-metallic surface that dynamic friction is comparable for all lubricants, but the inventive examples provide a reduced static friction which assists shift quality and synchronizer dis-engagement (or release) and provides improvements in shape of individual engagement curves as evidenced by the reduced curvature and slope gradient. In addition, the stability of dynamic friction is improved in by the inventive examples as evidenced by lower standard deviation of dynamic friction over the course of the 10,000 cycle test.

The amount of each chemical component described herein is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

The invention claimed is:

1. A method of lubricating a manual transmission which includes a synchronizer with carbon based surface, the method comprising supplying thereto a lubricant comprising:

(a) an oil of lubricating viscosity;

(b) about 0.14 percent to about 4 percent by weight of an overbased, carbonated magnesium or calcium arylsulfonate detergent; and (c) 0.01 to 2 wt % of stearic acid or a salt thereof;

wherein stearic acid or a salt thereof is premixed with detergent.

2. The method of claim 1, wherein the stearic acid or a salt thereof and the alkaline earth metal detergent are contacted during a process for preparing an overbased, carbonated magnesium or calcium arylsulfonate detergent in an oil medium comprising the steps of:

(1) providing an organic acid selected from a group consisting of:

a hydrocarbyl-substituted organic sulfonic acid, a mixture of a hydrocarbyl-substituted organic sulfonic acids, a metal salt of said organic acid, and mixtures thereof, (2) further providing at least one mono-alcohol;

(3) further providing a basic metal compound;

(4) further providing stearic acid (5) reacting the mixture of step (4) with carbon dioxide to form a carbonated overbased, carbonated magnesium or calcium arylsulfonate; wherein the resultant overbased, carbonated magnesium or calcium arylsulfonate detergent has a metal ratio of 5:1 to 27:1.

3. The method of claim 1, wherein the alkaline earth metal arylsulfonate detergent is an overbased, carbonated calcium arylsulfonate detergent.

4. The method of claim 1, wherein the arylsulfonate detergent comprises an alkylarylsulfonate anion in which the alkyl group is linear.

5. The method of claim 1, wherein the arylsulfonate is an alkyl-substituted benzenesulfonate or an alkyl-substituted toluenesulfonate.

6. The method 35, wherein the lubricant comprises calcium in an amount of about 0.03 to about 1.0 weight percent.

7. The method of claim 1, wherein the amount of the overbased, carbonated calcium arylsulfonate detergent in the lubricant is about 0.5 percent to about 4 percent by weight.

8. The method of claim 7, wherein the overbased, carbonated calcium aryl sulfonate detergent has a TBN of about 650 to about 1000.

9. The method of claim 1, wherein the alkaline earth metal sulfonate detergent has a metal ratio in the range of 10 to 40.

10. The method of claim 1, wherein the lubricant further comprises a succinimide dispersant which has been treated with at least one of a borating agent and terephthalic acid.

* * * * *